US009425032B2

(12) United States Patent
Silivra et al.

(10) Patent No.: US 9,425,032 B2
(45) Date of Patent: Aug. 23, 2016

(54) OPTIMIZING DRAG FIELD VOLTAGES IN A COLLISION CELL FOR MULTIPLE REACTION MONITORING (MRM) TANDEM MASS SPECTROMETRY

(71) Applicant: Thermo Finnigan LLC, San Jose, CA (US)

(72) Inventors: Oleg Silivra, Milpitas, CA (US); Harald Oser, San Carlos, CA (US); Joshua T. Maze, Round Rock, TX (US); Terry Olney, Tracy, CA (US); Alan E. Schoen, Kilauea, HI (US)

(73) Assignee: Thermo Finnegan LLC, San Jose, CA (US)

( * ) Notice: Subject to any disclaimer, the term of this patent is extended or adjusted under 35 U.S.C. 154(b) by 0 days.

(21) Appl. No.: 14/742,115

(22) Filed: Jun. 17, 2015

(65) Prior Publication Data

US 2015/0364302 A1 Dec. 17, 2015

Related U.S. Application Data

(60) Provisional application No. 62/013,265, filed on Jun. 17, 2014.

(51) Int. Cl.
*H01J 49/42* (2006.01)
*H01J 49/00* (2006.01)

(52) U.S. Cl.
CPC ..... *H01J 49/005* (2013.01); *H01J 49/429* (2013.01); *H01J 49/4215* (2013.01); *H01J 49/4225* (2013.01)

(58) Field of Classification Search
CPC ..... H01J 49/005; H01J 49/4215; H01J 49/4225; H01J 49/429
See application file for complete search history.

(56) References Cited

U.S. PATENT DOCUMENTS

| | | | | |
|---|---|---|---|---|
| 3,147,445 | A * | 9/1964 | Wuerker | H01J 25/49 250/292 |
| 5,847,386 | A * | 12/1998 | Thomson | H01J 49/4225 250/288 |
| 6,403,955 | B1 * | 6/2002 | Senko | H01J 49/027 250/290 |
| 7,675,031 | B2 * | 3/2010 | Konicek | H01J 49/4225 250/281 |
| 7,692,143 | B2 * | 4/2010 | Guna | H01J 49/0063 250/292 |
| 2002/0166959 | A1 * | 11/2002 | Bandura | H01J 49/0045 250/282 |
| 2006/0284072 | A1 * | 12/2006 | Hashimoto | H01J 49/004 250/287 |
| 2008/0073508 | A1 * | 3/2008 | Hashimoto | H01J 49/0045 250/288 |
| 2009/0294641 | A1 * | 12/2009 | Konicek | H01J 49/4225 250/281 |
| 2011/0248157 | A1 * | 10/2011 | Sugiyama | H01J 49/063 250/282 |
| 2012/0168619 | A1 * | 7/2012 | Guna | H01J 49/427 250/282 |
| 2013/0240724 | A1 * | 9/2013 | Guna | H01J 49/4225 250/283 |
| 2014/0353491 | A1 * | 12/2014 | Hager | H01J 49/0031 250/282 |

* cited by examiner

*Primary Examiner* — Wyatt Stoffa
(74) *Attorney, Agent, or Firm* — David A. Schell

(57) ABSTRACT

A collision cell has a plurality of rod electrodes arranged in opposed pairs around an axial centerline and a plurality of drag vanes arranged in the interstitial spaces between the rod electrodes. Operating the collision cell includes, applying a rod offset voltage to the rod electrodes, and varying an offset voltage applied to the drag vanes to identify a vane offset voltage with a maximum intensity for the transition. The method further includes varying a drag field by adjusting the voltages applied to drag vane terminals in opposite directions to identify a drag field value with a cross talk below a cross talk threshold, varying the vane offset voltage by adjusting the voltages applied to the drag vane terminals to maximize the intensity of the transition while preserving the drag field, and operating the collision cell at the vane offset voltage and drag field to monitor the transition.

33 Claims, 8 Drawing Sheets

OPTIMIZING DRAG FIELD VOLTAGES IN A COLLISION CELL FOR MULTIPLE REACTION MONITORING (MRM) TANDEM MASS SPECTROMETRY

INTRODUCTION

The present invention relates generally to triple quadrupole mass spectrometers, and more particularly to a method of operating a collision cell of a triple quadrupole mass spectrometer to minimize crosstalk in multiple reaction monitoring (MRM) mode.

BACKGROUND OF THE INVENTION

Triple quadrupole mass spectrometers are used widely for the analysis of a variety of substances. As the name denotes, triple quadrupole mass spectrometers include three quadrupole structures for mass analysis: a first quadrupole (also referred to as a quadrupole mass filter, or QMF) that selectively transmits precursor ions having a specified mass-to-charge ratio (m/z), a second quadrupole positioned within a gas-filled enclosure (referred to as a collision cell) for receiving the precursor ions transmitted through the first resolving quadrupole and causing the ions to undergo fragmentation into product ions, and a third quadrupole that receives the product ions from the second quadrupole and selectively transmits product ions having a specified m/z to a detector. The first, second and third quadrupoles are referred to herein as Q1, Q2 and Q3, respectively.

Selective reaction monitoring (SRM) is commonly employed in triple quadrupole mass spectrometers to detect and quantify targeted analytes. In SRM, Q1 and Q3 (both of which are operated as QMFs) are tuned to respectively transmit only the characteristic precursor and product ions of the targeted analyte. The monitored m/z values of the precursor and product ions are called a transition. By selecting the appropriate transition, an analyte may be detected and/or quantified at high sensitivity and with high specificity. When concurrent measurement of multiple analytes is desired, the Q1 and Q3 are operated to rapidly cycle between different transitions, each corresponding to one of the targeted analytes. This mode of operation is referred to as multiple reaction monitoring (MRM).

A key performance metric of modern triple quadrupole mass spectrometers is the rate at which MRM analysis may be conducted, i.e., the number of transitions that may be cycled through per unit time. Some commercial manufacturers advertise their instruments as being capable of monitoring in excess of 500 transitions/second. High MRM rates are facilitated by accelerating the transmission of ions through the relatively high-pressure environment of the collision cell (Q2) by establishing an axial direct current (DC) field that urges ions toward the exit of Q2. The axial DC field, sometimes called a "drag field", is typically established by applying potentials to a set of auxiliary electrodes (drag vanes) positioned between the rod electrodes that constitute the quadrupole. Electrode structures and associated methods for creating a drag field are disclosed, for example, in U.S. Pat. No. 7,675,031 ("Auxiliary Drag Field Electrodes" by Konicek et al., issued Mar. 9, 2010), the disclosure of which is incorporated herein by reference.

It is known that the phenomenon of cross-talk may significantly compromise performance when a triple quadrupole mass spectrometer is operated at high MRM rates. Cross-talk occurs when there are two consecutive transitions with the same m/z product ions generated from precursor ions of different m/z's. Due to the high MRM rate, the collision cell ($Q_2$) may not have sufficient time to clear the product ions from the first transition before switching to the second transition. In these cases product ions from earlier transitions can appear in the chromatogram for the second transition as a "ghost peak". The cross-talk effect can be particularly problematic if the ions corresponding to the first transition are of high intensity, as it can lead to more plausible false positives on the subsequent transition.

It is an objective of the present invention to provide a method of operating a triple quadrupole mass spectrometer, and in particular the collision cell thereof, to avoid or minimize cross-talk at high MRM rates while still maintaining good sensitivity.

SUMMARY

In a first aspect, a collision cell can have a plurality of rod electrodes arranged in opposed pairs around an axial centerline and a plurality of drag vane arranged in the interstitial spaces between the rod electrodes. A method of operating the collision cell can include confining ions producing a transition, applying a rod offset voltage to the rod electrodes, varying an offset voltage applied to the drag vanes to identify a vane offset voltage with a maximum intensity for the transition, varying a drag field by adjusting the voltages applied to drag vane terminals located at a proximal end and a distal end of the drag vanes in opposite amounts with respect to the offset voltage to identify a drag field value with a cross talk to an alternate transition below a cross talk threshold, varying the vane offset voltage by adjusting the voltages applied to the drag vane terminals by equal amounts to maximize the intensity of the transition while preserving the drag field, and operating the collision cell at the vane offset voltage and drag field to monitor the transition.

In various embodiments of the first aspect, the plurality of rod electrodes can include at least 4 rod electrodes.

In various embodiments of the first aspect, the plurality of rod electrodes can be placed with central symmetry around an axial centerline.

In various embodiments of the first aspect, the plurality of drag vanes includes at least two drag vanes and not more drag vanes than rod electrodes.

In various embodiments of the first aspect, varying the drag field can include adjusting the voltages applied to the drag vane terminals in equal and opposite amounts.

In various embodiments of the first aspect, the rod electrodes can have a square cross sectional area.

In various embodiments of the first aspect, the rod electrodes can have a circular cross sectional area.

In various embodiments of the first aspect, the rod electrodes can have a hyperbolic cross sectional area.

In various embodiments of the first aspect, the vane electrodes can include a plurality of conductive elements interconnected through a resistive network.

In various embodiments of the first aspect, the vane electrodes can be constructed from or coated with a resistive material.

In various embodiments of the first aspect, the vane electrodes can include a plurality of discrete electrically insulated elements placed along the length of the collision cell.

In various embodiments of the first aspect, the collision cell can have a substantially straight axial centerline.

In various embodiments of the first aspect, the collision cell can have a curved axial centerline.

In various embodiments of the first aspect, varying the offset voltage can include stepping the voltage by a step size between 2 V and 5 V.

In various embodiments of the first aspect, varying the offset voltage applied to the drag vanes can include varying the voltage around the rod offset voltage.

In a second aspect, a mass spectrometry system can include a collision cell and an instrument and data control system. The collision cell can have a plurality of rod electrodes arranged in opposed pairs around an axial centerline, and a plurality of drag vanes arranged in interstitial spaces between the rod electrodes, the drag vanes including a distal drag vane terminal and a proximal drag vane terminal. The instrument and data control system can be configured to apply a rod offset voltage to the rod electrodes, vary a offset voltage applied to the drag vanes to identify a vane offset voltage with a maximum intensity for the transition, vary a drag field by adjusting the voltages applied to drag vane terminals located at a proximal end and a distal end of the drag vanes in equal and opposite amounts to identify a drag field value with a cross talk to an alternate transition below a cross talk threshold, vary the vane offset voltage by adjusting the voltages applied to the drag vane terminals by equal amounts to maximize the intensity of the transition while preserving the drag field, and operate the collision cell at the vane offset voltage and drag field to monitor the transition.

In various embodiments of the second aspect, the plurality of rod electrodes can include at least 4 rod electrodes.

In various embodiments of the second aspect, the plurality of rod electrodes can be placed with central symmetry around an axial centerline.

In various embodiments of the second aspect, the plurality of drag vanes can include at least two drag vanes and not more drag vanes than rod electrodes.

In various embodiments of the second aspect, the rod electrodes can have a square cross sectional area.

In various embodiments of the second aspect, the rod electrodes can have a circular cross sectional area.

In various embodiments of the second aspect, the rod electrodes can have a hyperbolic cross sectional area.

In various embodiments of the second aspect, the vane electrodes can include a plurality of conductive elements interconnected through a resistive network.

In various embodiments of the second aspect, the vane electrodes can be constructed from or coated with a resistive material.

In various embodiments of the second aspect, the vane electrodes can include a plurality of discrete electrically insulated elements placed along the length of the collision cell.

In various embodiments of the second aspect, the collision cell can have a substantially straight axial centerline.

In various embodiments of the second aspect, the collision cell can have a curved axial centerline.

In various embodiments of the second aspect, varying the drag field can include adjusting the voltages applied to the drag vane terminals in equal and opposite amounts.

In various embodiments of the second aspect, varying the offset voltage can include stepping the voltage by a step size between 2 V and 5 V.

In various embodiments of the second aspect, varying the offset voltage can include varying the voltage around the rod offset voltage.

In various embodiments of the second aspect, the system can further include a detector, a first quadrupole mass filter configured to selectively transmit precursor ions having a specified mass-to-charge ratio to the collision cell, and a second quadrupole mass filter configured to receive product ions from the collision cell and selectively transmit product ions having a specified mass-to-charge ratio to the detector.

DRAWINGS

For a more complete understanding of the principles disclosed herein, and the advantages thereof, reference is now made to the following descriptions taken in conjunction with the accompanying drawings, in which.

Figure 1B:
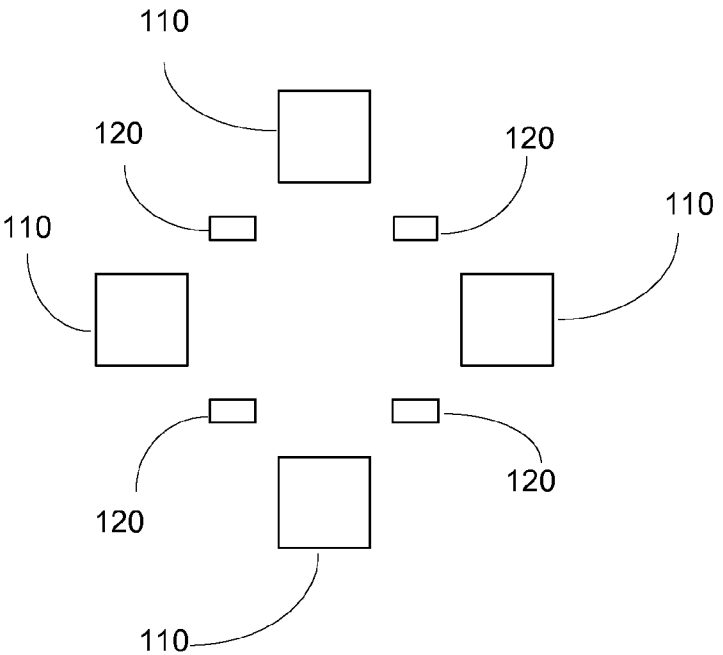
FIGS. 1A and 1B are illustrations of a collision cell, in accordance with various embodiments.

It is to be understood that the figures are not necessarily drawn to scale, nor are the objects in the figures necessarily drawn to scale in relationship to one another. The figures are depictions that are intended to bring clarity and understanding to various embodiments of apparatuses, systems, and methods disclosed herein. Wherever possible, the same reference numbers will be used throughout the drawings to refer to the same or like parts. Moreover, it should be appreciated that the drawings are not intended to limit the scope of the present teachings in any way.

DESCRIPTION OF EMBODIMENTS OF THE INVENTION

Embodiments of systems and methods for operating a collision cell of a triple quadrupole mass spectrometer are described herein.

The section headings used herein are for organizational purposes only and are not to be construed as limiting the described subject matter in any way.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless described otherwise, all technical and scientific terms used herein have a meaning as is commonly understood by one of ordinary skill in the art to which the various embodiments described herein belongs.

It will be appreciated that there is an implied "about" prior to the temperatures, concentrations, times, pressures, flow rates, cross-sectional areas, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular.

A "system" sets forth a set of components, real or abstract, comprising a whole where each component interacts with or is related to at least one other component within the whole.

Generally described, the present invention provides a method for optimizing certain operating conditions of a collision cell of a triple quadrupole mass spectrometer for a specified MRM transition in order to ensure that the abundance of ions at the specified transition is maximized while maintaining cross-talk below a predetermined limit. The method includes an initial step of applying a potential (referred to as the vane offset) along the drag vanes (auxiliary electrodes) of the collision cell and varying the potential within a window of values while measuring the intensities of the detected ions at a specified transition. Once the vane offset value that maximizes the detected signal intensity is identified, a drag field is established by adjusting the potentials applied at the entrance and exit ends of the drag vanes by equal but opposite amounts. The intensities of ions detected at the specified transition and a dummy transition are measured in order to determine cross-talk. The drag field is then gradually increased (by increasing the amounts by which the potentials applied to the entrance and exit ends of the vanes are displaced relative to the vane offset) until the measured cross-talk drops to a specified target. Next, the drag field is maintained at the value that is found to reduce cross-talk to the target, while the vane offset value is varied (by changing the voltages applied to the entrance and exit ends of the vane by the same amount and in the same direction), and the vane offset value is re-optimized for both cross-talk and signal.

Figure 1A:
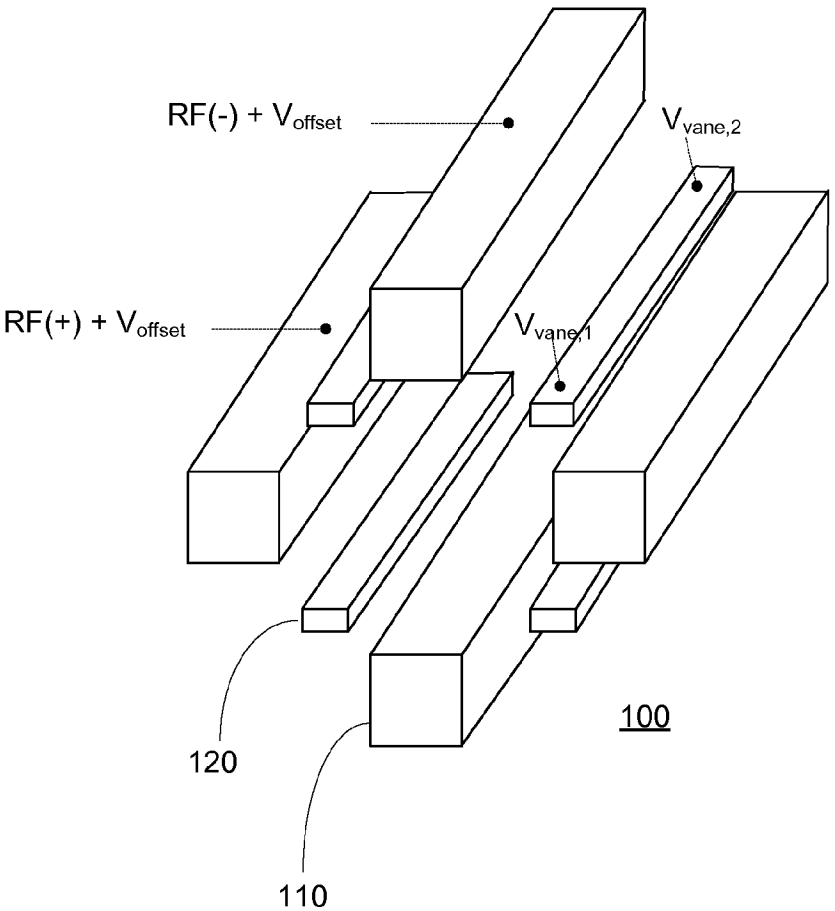
Figure 1D:
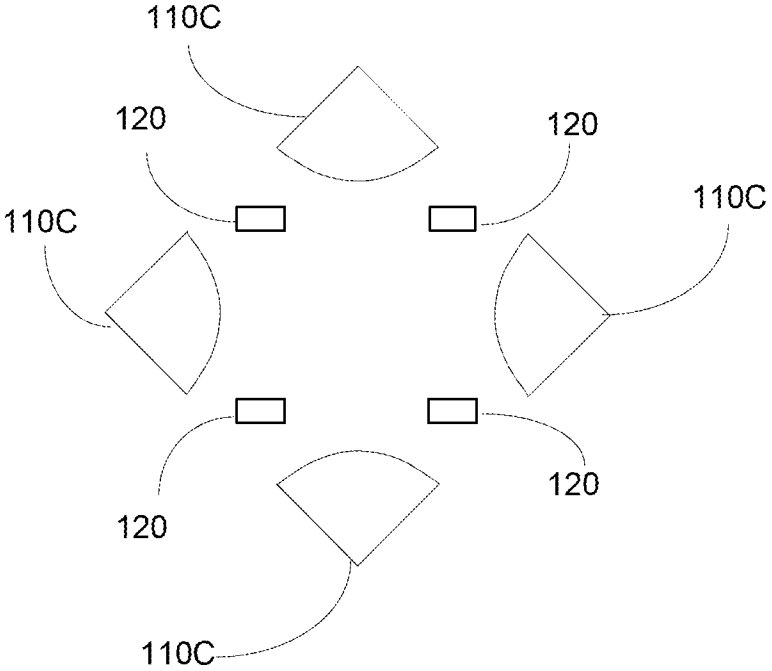
FIG. 1D is an illustration of a collision cell with rods having hyperbolic cross sections, in accordance with various embodiments.
Figure 1C:
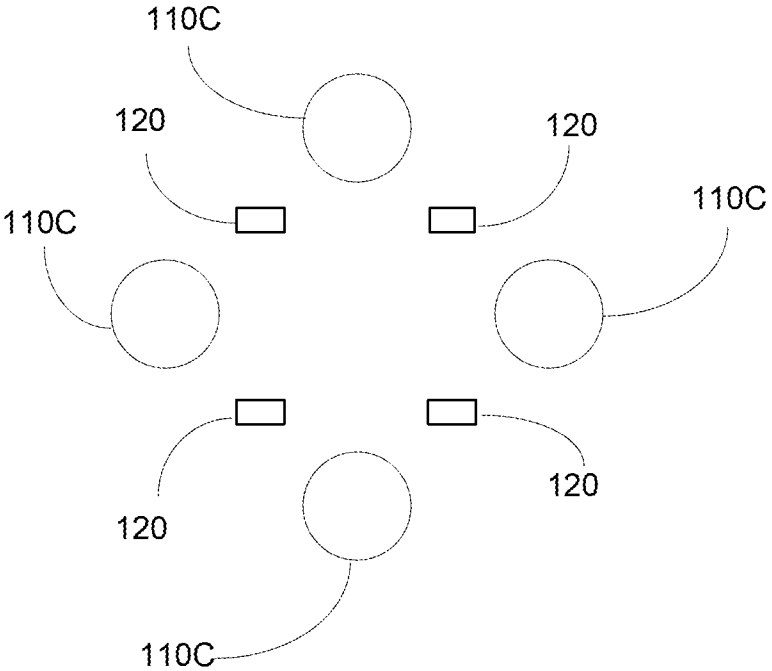
FIG. 1C is an illustration of a collision cell with rods having circular cross sections, in accordance with various embodiments.

An illustrative embodiment of the invention will now be discussed in reference to FIGS. 1-5. FIGS. 1A and 1B depict, in front perspective and front end views respectively, a collision cell 100 that may be utilized in connection with the drag field optimization method depicted in FIG. 2 and described below. Collision cell 100 is constructed from four primary rod electrodes 110 arranged in opposed pairs about a central ion flow axis, and four drag vanes (also referred to as auxiliary electrodes) 120 positioned in the interstitial spaces between the primary rod electrodes.

In various embodiments, the collision cell can include more than 4 rod electrodes, such as 6 or 8 or more rod electrodes, and other than 4 drag vanes. Generally, the rod electrodes are arranged with central symmetry around an axial centerline. In various embodiments, the number of drag vanes can be equal to the number of rod electrodes. In other embodiments, the number of drag vanes can be about half the number of rod electrodes, such that the drag vanes are located in every other interstitial space between the rod electrodes.

Primary rod electrodes 110 and drag vanes 120 can extend longitudinally from an entrance end to an exit end of collision cell 100. Primary rod electrodes 110 can be fabricated from a conductive metal (or from an insulative material coated with a layer of conductive metal). While primary rod electrodes 110 are depicted as having square cross sections (referred to as a "flatapole"), the present method may be utilized with collision cells having rod electrodes with any suitable cross-sectional shape, such as circular (see FIG. 1C) or hyperbolic (see FIG. 1D). As shown in FIG. 1A, an radio frequency (RF) voltage RF+ can be applied to one of the opposed electrode pairs, and an opposite phase RF voltage RF− can be applied to the other electrode pair. This can establish an oscillatory field that radially confines ions as they travel through the collision cell. A direct current (DC) offset voltage $V_{rod\ offset}$ can be applied to all four of the primary rod electrodes; this offset voltage (relative to upstream ion guides/optics) can cause ions entering collision cell 100 to be accelerated to specified kinetic energies suitable for fragmentation by collisionally activated dissociation. The rod electrodes and drag vanes can be positioned within an enclosure (not depicted) that is pressurized with an inert collision gas, such as nitrogen or argon. The RF and DC voltages can be applied to the rod electrodes and the drag vanes by RF and DC voltage supplies, which can operate under the control of an instrument data and control system. The data and control system can typically comprise a collection of general purpose and specialized processors, memory, storage devices, input/output devices, application specific circuitry and software/firmware logic. The methods described below can typically be implemented as software instructions stored and executed by the data and control system.

Figure 1E:
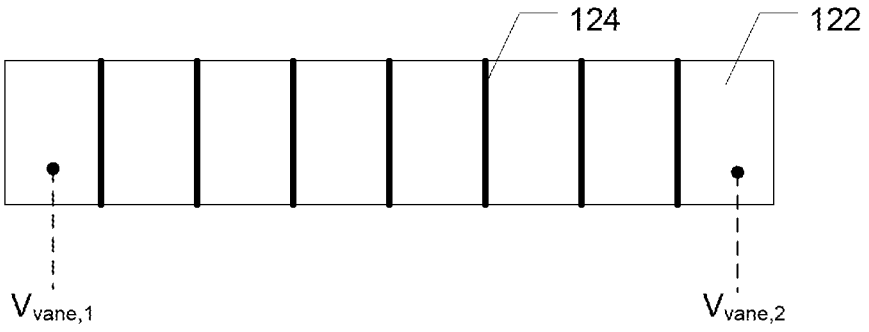
FIG. 1E is an illustration of a vane electrode with conductive elements connected through a resistive network, in accordance with various embodiments.

Drag vanes 120 are structures configured to establish an axial DC field (also referred to as a drag field) within collision cell 100 that can act to urge ions toward the exit end and thereby shorten transit times. Many designs of drag vanes are known in the art. In an illustrative example described in the aforementioned U.S. Pat. No. 7,675,031, each drag vane may be constructed of a plurality of conductive elements deposited on a PCB board substrate and spaced along the length of the drag vane. The conductive elements can be interconnected through a resistive network such that each conductive element receives a voltage progressively higher or lower (depending on the gradient of the drag field) relative to the preceding (in the direction of ion flow) conductive element. FIG. 1E shows a drag vane including a plurality of conductive elements 122 connected by resistive elements 124. The drag vane can also include two voltage terminals for receiving DC voltages from a voltage supply: a first terminal, receiving a voltage $V_{vane,1}$, located at or proximate to the entrance end of the collision cell and a second terminal, receiving a voltage $V_{vane,2}$ located at or proximate to the exit end of the collision cell. When different DC voltages are applied to the first and second terminals, it can create a DC gradient along the length of the vane which, in combination with the DC gradients created along the other drag vanes, can generate the axial DC field.

Figure 1F:
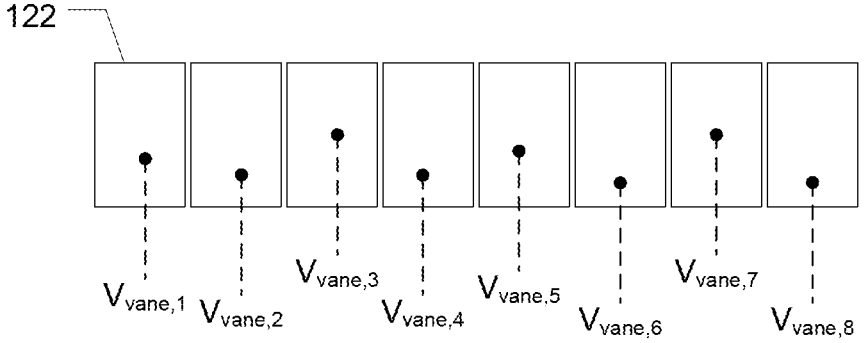
FIG. 1F is an illustration of a vane electrode with discrete electrically isolated elements, in accordance with various embodiments.

In other examples, the drag vanes may be constructed from or coated with a resistive material, with different voltages applied to opposite ends to generate the DC gradient. In other implementations, discrete, electrically insulated elements, such as rings or segmented rods, placed along the length of the collision cell, may be utilized to create the DC gradient. FIG. 1F shows a drag vane including a plurality of electrically insulated conductive elements 122 with different voltages applied to each element to create the DC gradient. Examples of a variety of structures useful for axial field generation in a collision cell are described in U.S. Pat. No. 5,847,386 ("Spectrometer with Axial Field" by Thomson et al., issued Dec. 8, 1998), the disclosure of which is incorporated herein by reference.

Figure 1G:
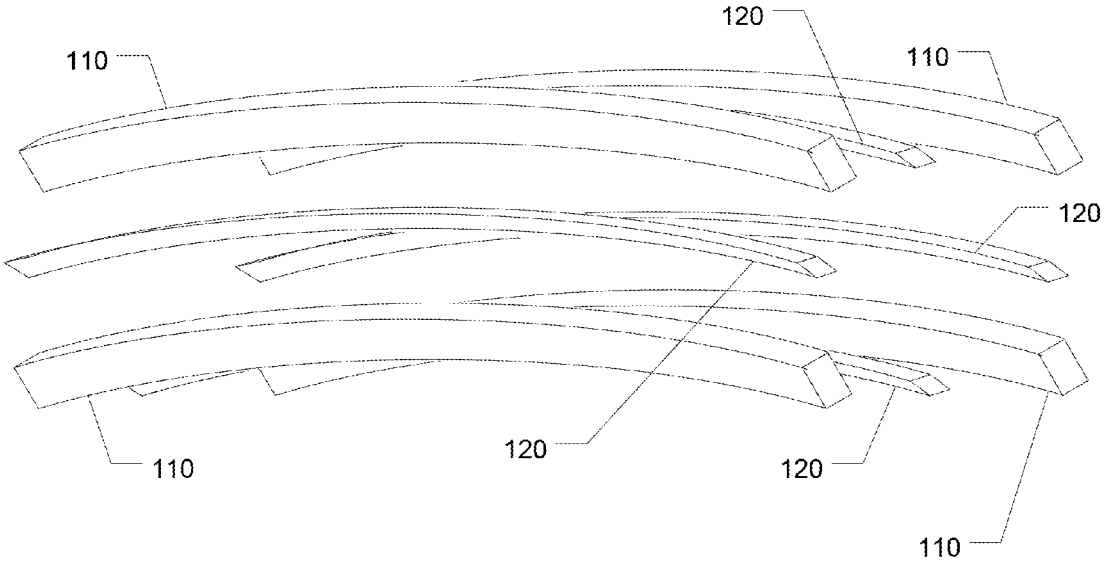
FIG. 1G is an illustration of a collision cell having a curved axial centerline, in accordance with various embodiments.

While collision cell 100 is shown as having a substantially straight axial centerline, the rod electrodes and drag vanes may alternatively be shaped and arranged to define a curved axial centerline, as illustrated in FIG. 1G.

Figure 2:
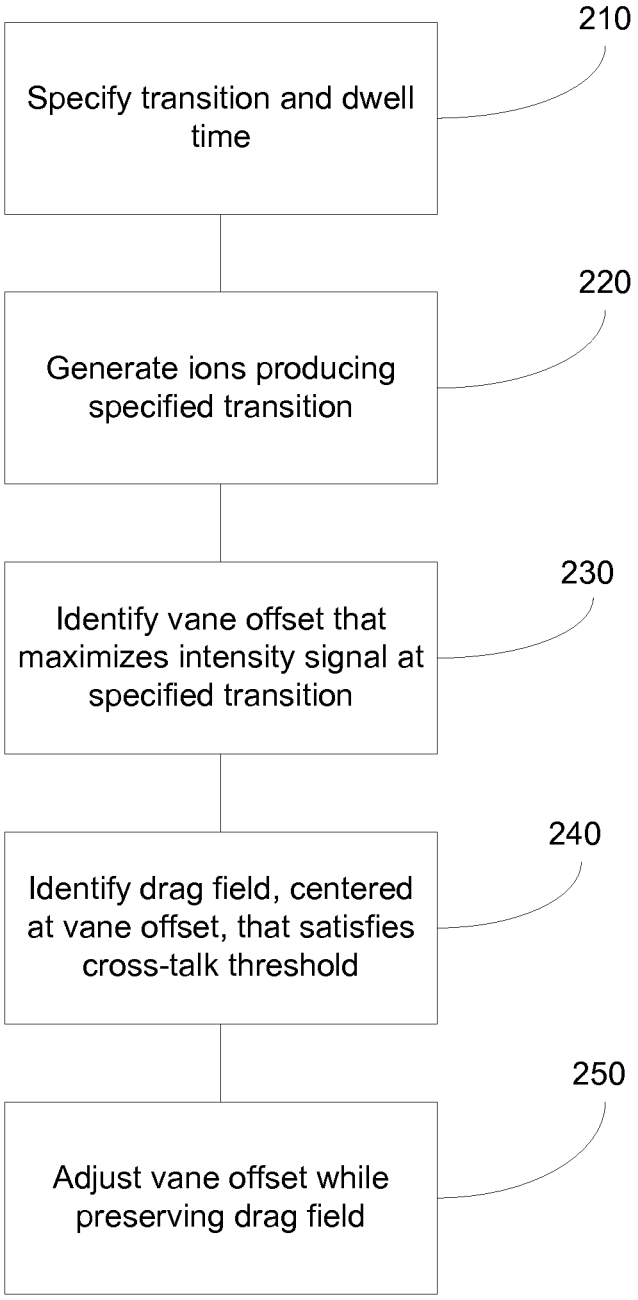
FIG. 2 is a flow diagram of an exemplary method for tuning the DC voltages applied to drag vanes of a collision cell, in accordance with various embodiments.

FIG. 2 depicts a flowchart depicting the steps of a method for tuning the DC voltages applied to drag vanes 120 of a collision cell 100 of the triple quadrupole mass spectrometer to maximize sensitivity while maintaining cross-talk below an acceptable threshold. In the first step 210, a transition can be selected for optimization; for example, the transition may comprise one of a set of monitored transitions for the measurement of pesticides in food products, or for the measurement of targeted peptides in a biological sample. The collision energy of the selected transition can be set using known techniques, e.g., employing stored calibration data or user-specified values. The dwell time (the time during which the quadrupoles can be fixed at the selected transition before moving on to the next transition on the list) for the selected transition can also be specified for the method, since the value of dwell time has a considerable influence on cross-talk. The QMFs can then be operated to monitor ions at the selected transition, for the specified dwell time. Preferably, the QMFs are operated in a simulated experiment mode, i.e., to rapidly cycle through a list of transitions, of which the selected transition constitutes one.

Figure 3:
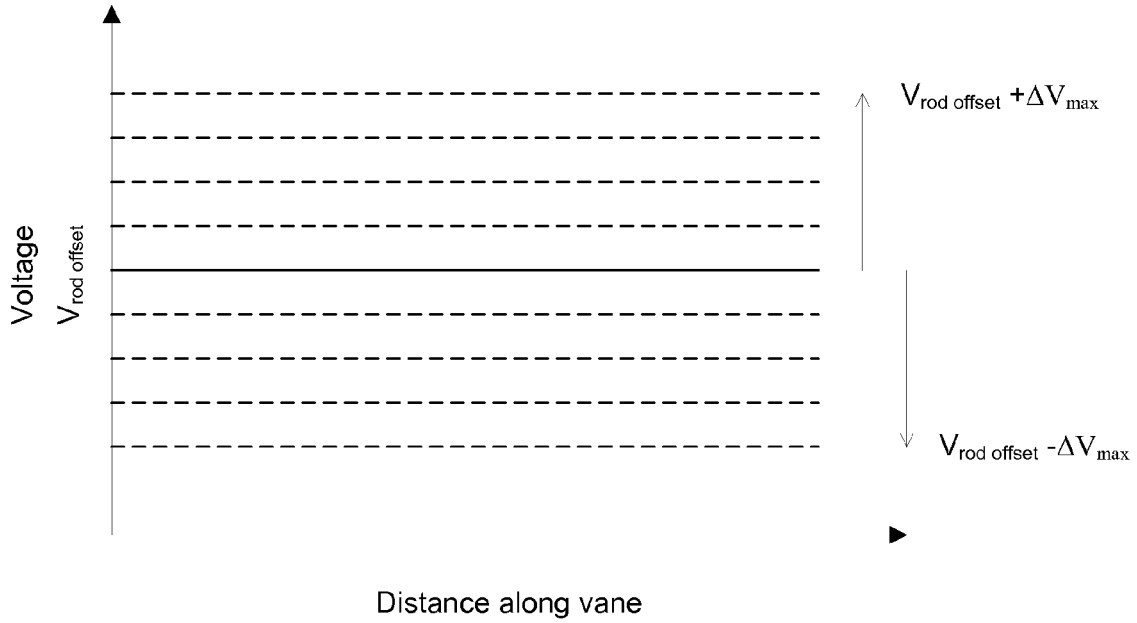
FIGS. 3 through 5 are diagrams illustrating adjustments to the DC voltages applied to drag vanes of a collision cell, in accordance with various embodiments.

In step 220, a sample can be introduced into the mass spectrometer having as a constituent the compound that produces ions corresponding to the selected transition. The method can then proceeds to optimize the vane offset voltage ($V_{vane\ offset}$), step 230. This can be accomplished by applying equal voltages to the two terminals of all of the drag vanes (i.e., $V_{vane,1}=V_{vane,2}$) and varying this voltage in a step-wise fashion to maximize the intensity of the detected signal for the selected transition. The range over which the vane offset voltage can be varied in step 230 may be centered around the rod offset voltage ($V_{rod\ offset}$) selected to provide the requisite collision energy for the transition, as shown in FIG. 3. In one example, $V_{rod\ offset}$ has an initial value of −20 V, and $V_{vane\ offset}$ is varied between −120 V ($V_{rod\ offset}$−100 V) and 80 V ($V_{rod\ offset}$+100 V). The step size for varying the vane offset voltage may be, for example, between 2 and 5 V. The value of the vane offset voltage can be set to the value within the tested range that produces the greatest intensity value for the selected transition. For example, it may be found that the intensity-optimized $V_{vane\ offset}$ is −30 V.

Next, in step 240, the drag field can be optimized around the optimized $V_{vane\ offset}$ identified in step 230 by displacing the voltages applied to the drag vane terminals ($V_{vane,1}=V_{vane,2}$) by equal and opposite amounts, and incrementally changing the magnitude of the displacement until the measured cross-talk is below a specified threshold. In alternative embodiments, the applied voltage can be displaced by unequal amounts. Cross-talk can be defined as the ratio of the total number of ions (i.e., signal intensity) detected for a dummy transition to the total number of ions detected for the selected (real) transition. For the dummy transition, a precursor ion m/z that is not expected to produce the monitored product ion can be chosen. For example, if the selected precursor-product ion transition is 322→260, then a dummy transition of 100→260 may be chosen.

Figure 4:
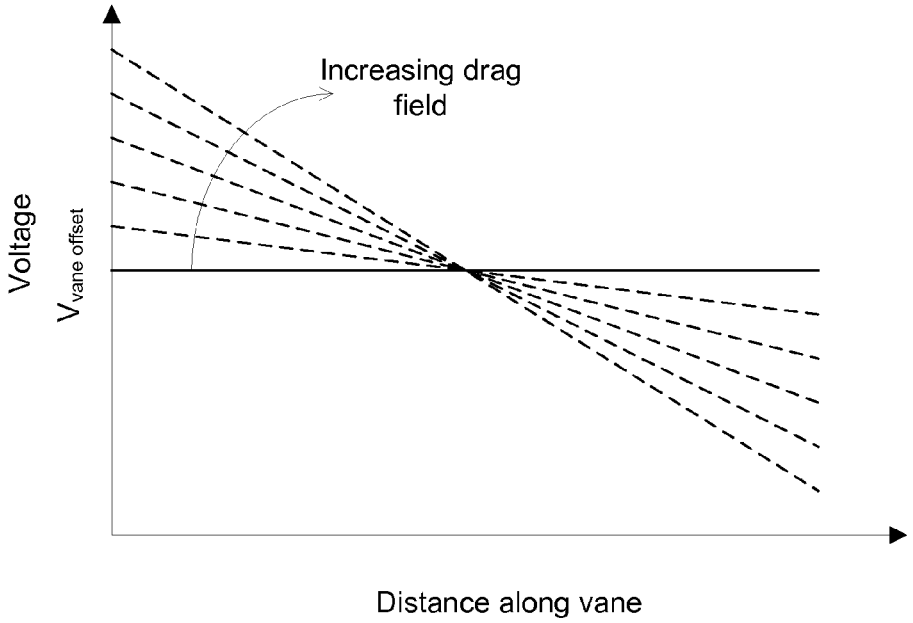

The variation of the drag field is depicted in FIG. 4. The drag vanes can be initially held at an axially invariant voltage (zero drag field) of $V_{vane\ offset}$. The magnitude of the drag field can then be increased in a step-wise fashion by raising $V_{vane,1}$ by a set amount relative to $V_{vane\ offset}$ and decreasing $V_{vane,2}$ by the same set amount (noting that, for positive ions, the local drag field potential will decrease in the direction of ion flow). Alternatively, $V_{vane,1}$ can be increased by a set amount relative to $V_{vane\ offset}$ and $V_{vane,2}$ can be decreased by a different set amount. For example, for the optimized $V_{vane\ offset}$ value of −30 V, $V_{vane,1}$ may be set to −25 V (−30 V+5 V) and $V_{vane,2}$ may be set to −35V, yielding a drag field value of −10 V (−35 V-(−25 V)). The cross-talk can be measured at this drag field value, and then increased (by increasing the magnitude of the displacement of $V_{vane,1}$ and $V_{vane,2}$ from $V_{vane\ offset}$) until the measured cross-talk can be at or below a specified threshold. In one example, the threshold is set at $5*10^{-5}$. The step size and maximum drag field value can be set by the method; for example, the drag field may be varied is steps of −10 V to a maximum of −200 V. If, in step 240, no field is found that yields a value of cross-talk falling at or below the threshold, then the drag field is set to the maximum value.

Figure 5:
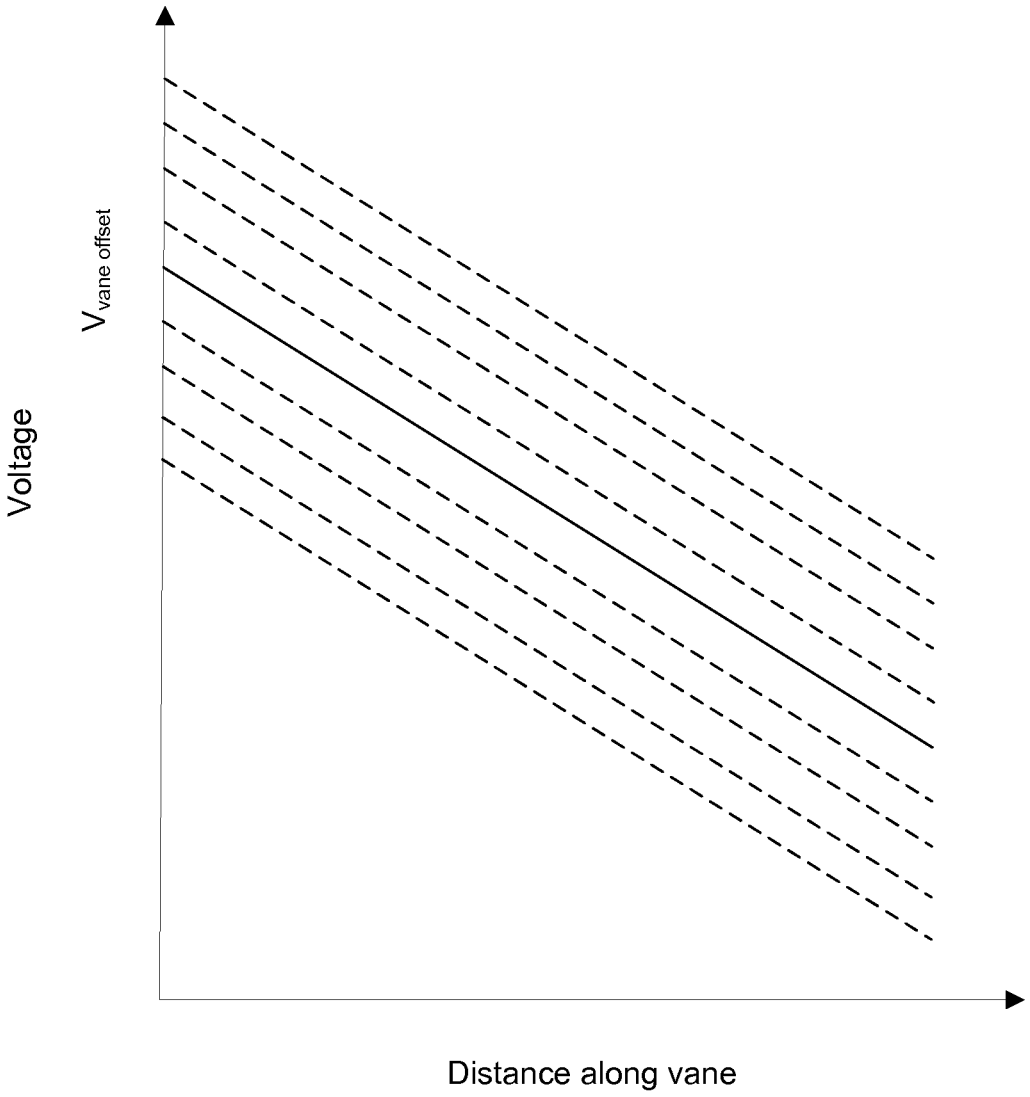

After a drag field value that satisfies the desired threshold target is identified in step 240 (or, if this criterion isn't met, the drag field is set to the maximum value), the value of $V_{vane\ offset}$ can be re-optimized while the drag field is maintained at the value identified in step 230. The variation of $V_{vane\ offset}$ during this step 250 is represented by FIG. 5, and the variation can be performed by increasing or decreasing $V_{vane,1}$ and $V_{vane,2}$ by equal amounts in prescribed steps. For example, assume that $V_{vane\ offset}$ selected in step 230 is −30 V, and the drag field identified in step 140 that produces acceptable cross-talk is −50 V. These values place $V_{vane,1}$ at −5 V and $V_{vane,2}$ at −55 V. In step 130, $V_{vane\ offset}$ may be initially increased by 5 V while preserving the −50 V drag field by raising $V_{vane,1}$ to 0V and raising $V_{vane,2}$ to −50V. As depicted in FIG. 5, this step-wise variation can be repeated within a specified range about the optimized value of $V_{vane\ offset}$ identified in step 230. At each adjusted value of $V_{vane\ offset}$, the intensity and cross-talk at the selected transition can be measured, and the value of $V_{vane\ offset}$ that maximizes the signal intensity while still maintaining cross-talk below the threshold target can be identified as the re-optimized $V_{vane\ offset}$, and that value and the drag field value identified in step 240 can be stored in association with the selected transition and dwell time for use in subsequent sample analysis It has been observed that optimizing the drag field voltages for a specified transition and dwell time using the foregoing method can result in a decrease (relative to operation with default, non-optimized values) in cross-talk by up to two orders of magnitude. Typical dynamic range levels achieved after executing the optimization routine can be approximately six orders of magnitude between the selected and dummy transitions.

Those skilled in the art will recognize that the steps described above may be repeated (or performed in parallel) to separately optimize drag field voltages for a plurality of transitions and/or dwelling times, such that the optimal values for a various transitions and/or dwell times may be stored for subsequent sample analysis.

Mass Spectrometry Platforms

Figure 6:
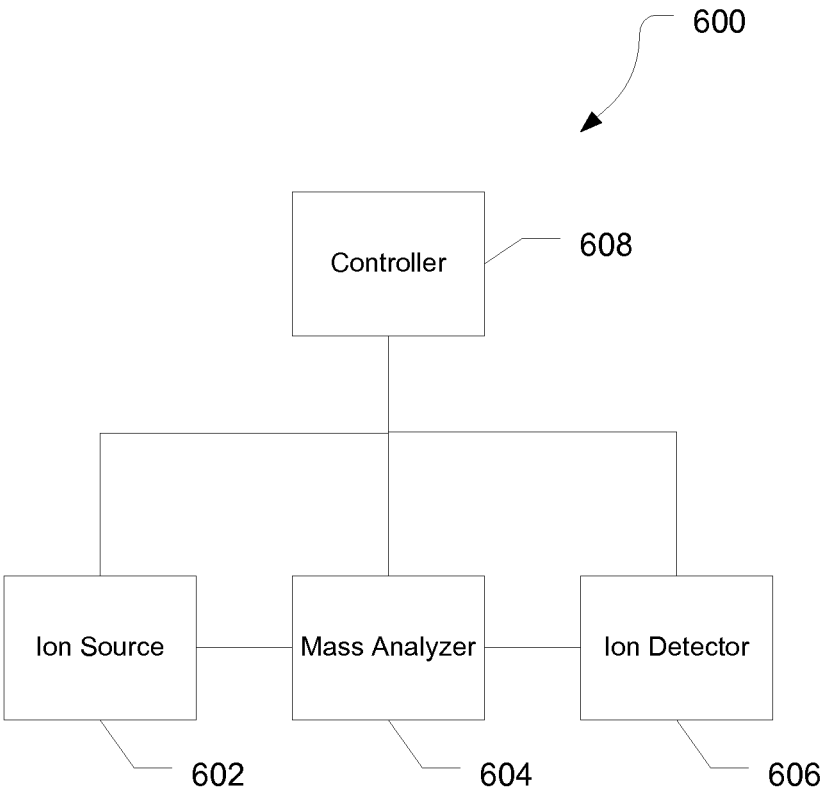
FIG. 6 is an exemplary mass spectrometer system, in accordance with various embodiments.

Various embodiments of mass spectrometry platform 600 can include components as displayed in the block diagram of FIG. 6. In various embodiments, elements of FIG. 6 can be incorporated into mass spectrometry platform 600. According to various embodiments, mass spectrometer 600 can include an ion source 602, a mass analyzer 604, an ion detector 606, and a controller 608.

In various embodiments, the ion source 602 generates a plurality of ions from a sample. The ion source can include, but is not limited to, a matrix assisted laser desorption/ionization (MALDI) source, electrospray ionization (ESI) source, atmospheric pressure chemical ionization (APCI) source, atmospheric pressure photoionization source (APPI), inductively coupled plasma (ICP) source, electron ionization source, chemical ionization source, photoionization source, glow discharge ionization source, thermospray ionization source, and the like.

In various embodiments, the mass analyzer 604 can separate ions based on a mass-to-charge ratio of the ions. For example, the mass analyzer 604 can include a quadrupole mass filter analyzer, a quadrupole ion trap analyzer, a time-of-flight (TOF) analyzer, an electrostatic trap (e.g., Orbitrap) mass analyzer, Fourier transform ion cyclotron resonance (FT-ICR) mass analyzer, and the like. In various embodiments, the mass analyzer 604 can also be configured to fragment the ions using collision induced dissociation (CID) electron transfer dissociation (ETD), electron capture dissociation (ECD), photo induced dissociation (PID), surface induced dissociation (SID), and the like, and further separate the fragmented ions based on the mass-to-charge ratio.

In various embodiments, the ion detector 606 can detect ions. For example, the ion detector 606 can include an electron multiplier, a Faraday cup, and the like. Ions leaving the mass analyzer can be detected by the ion detector. In various embodiments, the ion detector can be quantitative, such that an accurate count of the ions can be determined.

In various embodiments, the controller 608 can communicate with the ion source 602, the mass analyzer 604, and the ion detector 606. For example, the controller 608 can configure the ion source or enable/disable the ion source. Additionally, the controller 608 can configure the mass analyzer 604 to select a particular mass range to detect. Further, the controller 608 can adjust the sensitivity of the ion detector 606, such as by adjusting the gain. Additionally, the controller 608 can adjust the polarity of the ion detector 606 based on the polarity of the ions being detected. For example, the ion detector 606 can be configured to detect positive ions or be configured to detected negative ions.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

It should also be understood that the embodiments described herein can employ various computer-implemented operations involving data stored in computer systems. These operations are those requiring physical manipulation of physical quantities. Usually, though not necessarily, these quantities take the form of electrical or magnetic signals capable of being stored, transferred, combined, compared, and otherwise manipulated. Further, the manipulations performed are often referred to in terms, such as producing, identifying, determining, or comparing.

Any of the operations that form part of the embodiments described herein are useful machine operations. The embodiments, described herein, also relate to a device or an apparatus for performing these operations.

What is claimed is:

1. A method of operating a collision cell having a plurality of rod electrodes arranged in opposed pairs around an axial centerline and a plurality of drag vanes arranged in the interstitial spaces between the rod electrodes, comprising:

confining ions producing a transition;

applying a rod offset voltage to the rod electrodes;

varying an offset voltage applied to the drag vanes to identify a vane offset voltage with a maximum intensity for the transition;

varying a drag field by adjusting the voltages applied to drag vane terminals located at a proximal end and a distal end of the drag vanes in opposite amounts with respect to the offset voltage to identify a drag field value with a cross talk to an alternate transition below a cross talk threshold;

varying the vane offset voltage by adjusting the voltages applied to the drag vane terminals by equal amounts to maximize the intensity of the transition while preserving the drag field; and operating the collision cell at the vane offset voltage and drag field to monitor the transition.

2. The method of claim 1, wherein the plurality of rod electrodes includes at least 4 rod electrodes.

3. The method of claim 1, wherein the plurality of rod electrodes are placed with central symmetry around an axial centerline.

4. The method of claim 1, wherein the plurality of drag vanes includes at least two drag vanes.

5. The method of claim 1, wherein the plurality of drag vanes includes not more drag vanes than rod electrodes.

6. The method of claim 1, wherein varying the drag field includes adjusting the voltages applied to the drag vane terminals in equal and opposite amounts.

7. The method of claim 1, wherein the rod electrodes have a square cross sectional area.

8. The method of claim 1, wherein the rod electrodes have a circular cross sectional area.

9. The method of claim 1, wherein the rod electrodes have a hyperbolic cross sectional area.

10. The method of claim 1, wherein the vane electrodes include a plurality of conductive elements interconnected through a resistive network.

11. The method of claim 1, wherein the vane electrodes are constructed from or coated with a resistive material.

12. The method of claim 1, wherein the vane electrodes include a plurality of discrete electrically insulated elements placed along the length of the collision cell.

13. The method of claim 1, wherein the collision cell has a substantially straight axial centerline.

14. The method of claim 1, wherein the collision cell has a curved axial centerline.

15. The method of claim 1, wherein varying the offset voltage includes stepping the voltage by a step size between 2 V and 5 V.

16. The method of claim 1, wherein varying the offset voltage applied to the drag vanes includes varying the voltage within a range centered at the rod offset voltage.

17. A mass spectrometry system comprising:

a collision cell having:

a plurality of rod electrodes arranged in opposed pairs around an axial centerline, and a plurality of drag vanes arranged in interstitial spaces between the rod electrodes, the drag vanes including a distal drag vane terminal and a proximal drag vane terminal;

an instrument and data control system configured to:

apply a rod offset voltage to the rod electrodes;

vary a offset voltage applied to the drag vanes to identify a vane offset voltage with a maximum intensity for the transition;

vary a drag field by adjusting the voltages applied to drag vane terminals located at a proximal end and a distal end of the drag vanes in equal and opposite amounts to identify a drag field value with a cross talk to an alternate transition below a cross talk threshold;

vary the vane offset voltage by adjusting the voltages the voltages applied to the drag vane terminals by equal amounts to maximize the intensity of the transition while preserving the drag field; and operate the collision cell at the vane offset voltage and drag field to monitor the transition.

18. The mass spectrometry system of claim 17, wherein the plurality of rod electrodes includes at least 4 rod electrodes.

19. The mass spectrometry system of claim 17, wherein the plurality of rod electrodes are placed with central symmetry around an axial centerline.

20. The mass spectrometry system of claim 17, wherein the plurality of drag vane includes at least two drag vanes.

21. The mass spectrometry system of claim 17, wherein the plurality of drag vanes includes not more drag vanes than rod electrodes.

22. The mass spectrometry system of claim 17, wherein the rod electrodes have a square cross sectional area.

23. The mass spectrometry system of claim 17, wherein the rod electrodes have a circular cross sectional area.

24. The mass spectrometry system of claim 17, wherein the rod electrodes have a hyperbolic cross sectional area.

25. The mass spectrometry system of claim 17, wherein the vane electrodes include a plurality of conductive elements interconnected through a resistive network.

26. The mass spectrometry system of claim 17, wherein the vane electrodes are constructed from or coated with a resistive material.

27. The mass spectrometry system of claim 17, wherein the vane electrodes include a plurality of discrete electrically insulated elements placed along the length of the collision cell.

28. The mass spectrometry system of claim 17, wherein the collision cell has a substantially straight axial centerline.

29. The mass spectrometry system of claim 17, wherein the collision cell has a curved axial centerline.

30. The mass spectrometry system of claim 17, wherein varying the drag field includes adjusting the voltages applied to the drag vane terminals in equal and opposite amounts.

31. The mass spectrometry system of claim 17, wherein varying the offset voltage includes stepping the voltage by a step size between 2 V and 5 V.

32. The mass spectrometry system of claim 17, wherein varying the offset voltage includes varying the voltage within a range centered at the rod offset voltage.

33. The mass spectrometry system of claim 17, further comprising:

a detector; and a first quadrupole mass filter configured to selectively transmit precursor ions having a specified mass-to-charge ratio to the collision cell; and a second quadrupole mass filter configured to receive product ions from the collision cell and selectively transmit product ions having a specified mass-to-charge ratio to the detector.

* * * * *